US006894259B2

(12) United States Patent
Lee

(10) Patent No.: US 6,894,259 B2
(45) Date of Patent: May 17, 2005

(54) WALL-MOUNTED TYPE MICROWAVE OVEN

(75) Inventor: Se-Hun Lee, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 11 days.

(21) Appl. No.: 10/625,555

(22) Filed: Jul. 24, 2003

(65) Prior Publication Data

US 2004/0134909 A1 Jul. 15, 2004

(30) Foreign Application Priority Data

Jan. 9, 2003 (KR) ..... 10-2003-0001429

(51) Int. Cl.[7] ..... H05B 6/80

(52) U.S. Cl. ..... 219/756; 219/757; 312/236; 126/273 A; 126/299 R

(58) Field of Search ..... 219/756–757, 219/400; 312/236; 126/21 R, 273 A, 21 A, 275 E, 299 R, 299 P

(56) References Cited

U.S. PATENT DOCUMENTS 4,313,043 A * 1/1982 White et al. ..... 219/757
4,666,113 A 5/1987 Itoh et al.
5,286,940 A * 2/1994 Leeds ..... 219/762
5,967,634 A * 10/1999 Baca ..... 312/242
6,222,171 B1 4/2001 Fukuda et al.
6,369,372 B1 * 4/2002 Kim ..... 219/756
2002/0050491 A1 5/2002 Kim

OTHER PUBLICATIONS

Communication including European Search Report from the European Patent Office dated Apr. 23, 2004 for the corresponding European patent application.
Korean Patent Abstracts for Publication No. 1020020033857 dated 20020508.

* cited by examiner

*Primary Examiner*—Philip H. Leung
(74) *Attorney, Agent, or Firm*—Staas & Halsey LLP

(57) ABSTRACT

A wall-mounted type microwave oven to prevent deformation and drooping of an outer cabinet thereof. The microwave oven includes an outer cabinet defining an outer appearance of the wall-mounted type microwave oven, and an inner cabinet disposed in the outer cabinet with a predetermined spacing therebetween. The inner cabinet includes a hanger member extending from the inner cabinet to allow the inner cabinet to be secured to an installation base, and a fastening device to secure the hanger member to the installation base. The hanger member secures the inner cabinet as well as the outer cabinet to the installation base. A weight of the wall-mounted type microwave oven is distributed to the outer cabinet and the inner cabinet, thereby preventing deformation of the outer cabinet.

22 Claims, 4 Drawing Sheets

WALL-MOUNTED TYPE MICROWAVE OVEN

CROSS-REFERENCE TO RELATED APPLICATION

This application claims the benefit of Korean Application No. 2003-1429, filed Jan. 9, 2003, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven, which is adapted to prevent a deformation and a drooping of an outer cabinet thereof.

2. Description of the Related Art

In general, a microwave oven is a cooking appliance which is intended to cook foods by intermolecular frictional heating of the foods, which is generated by repeatedly agitating water molecules of the foods with high-frequency electromagnetic energy. Among such microwave ovens, a microwave oven, which is fixedly installed over a cooking device, such as a gas oven range, to serve as a hood to exhaust contaminated air to an outside, is usually referred as a wall-mounted type microwave oven.

A conventional wall-mounted type microwave oven is generally installed over the gas oven range in a kitchen, and performs an operation of exhausting, for example, exhaust gas and fumes generated from the gas oven range disposed therebelow, to the outside, as well as a cooking operation as in a conventional wall-mounted type microwave oven.

The wall-mounted type microwave oven includes an outer cabinet defining an outer appearance of the wall-mounted type microwave oven, and an inner cabinet disposed in the outer cabinet with a predetermined spacing therebetween, so as to enable the predetermined spacing to serve as a duct to guide contaminated air. The inner cabinet is provided therein with a cooking chamber to cook foods therein, and an electric component compartment to receive various electric components, the cooking chamber and electric component compartment being isolated from each other.

The wall-mounted type microwave oven includes an upper panel having an upper surface of the outer cabinet, which is securely attached to a lower surface of an installation base, such as a ceiling of the kitchen or a kitchen cabinet, by fasteners such as bolts and nuts and is thereby suspended. In an operation of installing the wall-mounted type microwave oven to the installation base, the nuts are first held by additional nut holders attached to a lower surface of the upper panel, and the bolts are passed through the installation base and the outer cabinet and engaged with the nuts.

However, since the outer cabinet of the conventional wall-mounted type microwave oven is comprised of thin plate material, the upper panel of the outer cabinet may be deformed or may droop by a weight of the wall-mounted type microwave oven over time.

Furthermore, since the additional nut holders are needed to hold nuts on the upper panel, production cost is increased.

SUMMARY OF THE INVENTION

Accordingly, it is an aspect of the present invention to provide a wall-mounted type microwave oven, which prevents a deformation and a drooping of an outer cabinet thereof.

It is another aspect to provide a wall-mounted type microwave oven, which reduces a number of associated components, thereby decreasing production cost.

Additional aspects and/or advantages of the invention will be set forth in part in the description which follows and, in part, will be obvious from the description, or may be learned by practice of the invention.

The above and/or other aspects are achieved by providing a wall-mounted type microwave oven including an outer cabinet defining an outer appearance of the wall-mounted type microwave oven, an inner cabinet disposed in the outer cabinet with a predetermined spacing therebetween, and having a cooking chamber to cook foods therein and an electric component compartment to receive electric components. The cooking chamber and the electric component compartments are isolated from each other. A hanger member extends from the inner cabinet to allow the inner cabinet to be secured to an installation base in a kitchen, and a fastening device secures the hanger member to the installation base.

The fastening device includes a bolt and a nut. The bolt passes through the installation base, the outer cabinet and the hanger member. The nut is disposed under the hanger member and engages with the bolt.

The hanger member includes a seat piece on which the nut is seated, and a resilient hook piece to allow the nut to be seated on the seat piece and to prevent the nut from separating from the seat piece.

The seat piece is downwardly extended from a lower surface of the hanger member and laterally bent to have an "L"-shaped section, so as to allow the nut to be seated on the bent portion, and the resilient hook piece is positioned at an opening side of the seat piece to prevent the nut from separating from the seat piece.

The nut has a square shape, which is in contact with the seat piece and the resilient hook piece at sides thereof, so as not to allow the nut to rotate when the bolt engages therewith.

The hanger member extends from a partition plate, which is attached to an upper and front portion of the inner cabinet defining the electric component compartment, to define a flow path to cool the electric component compartment.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENT

Figure 1:
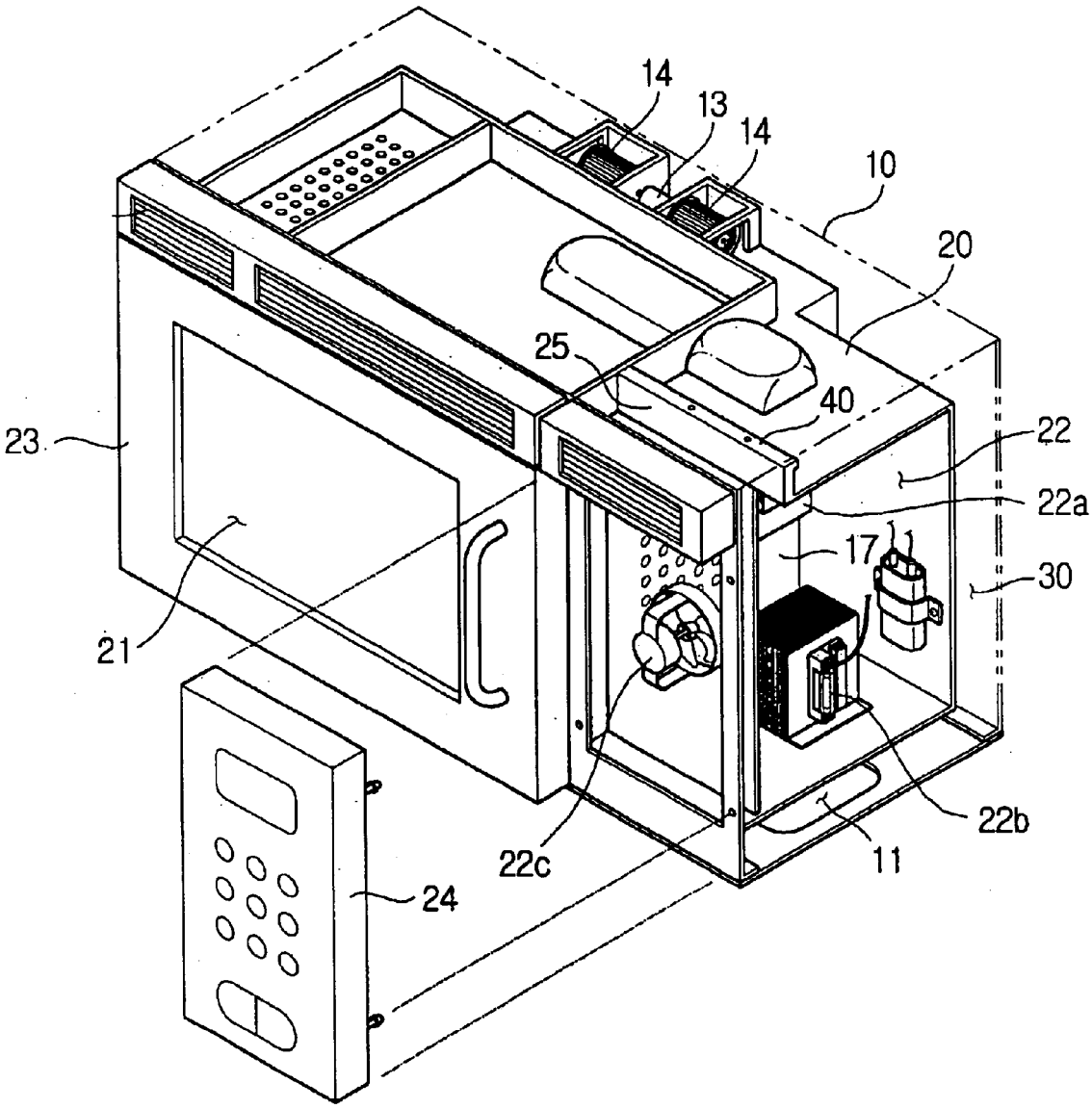
FIG. 1 is a perspective view of a wall-mounted type microwave oven, according to an embodiment of the present invention.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

Figure 2:
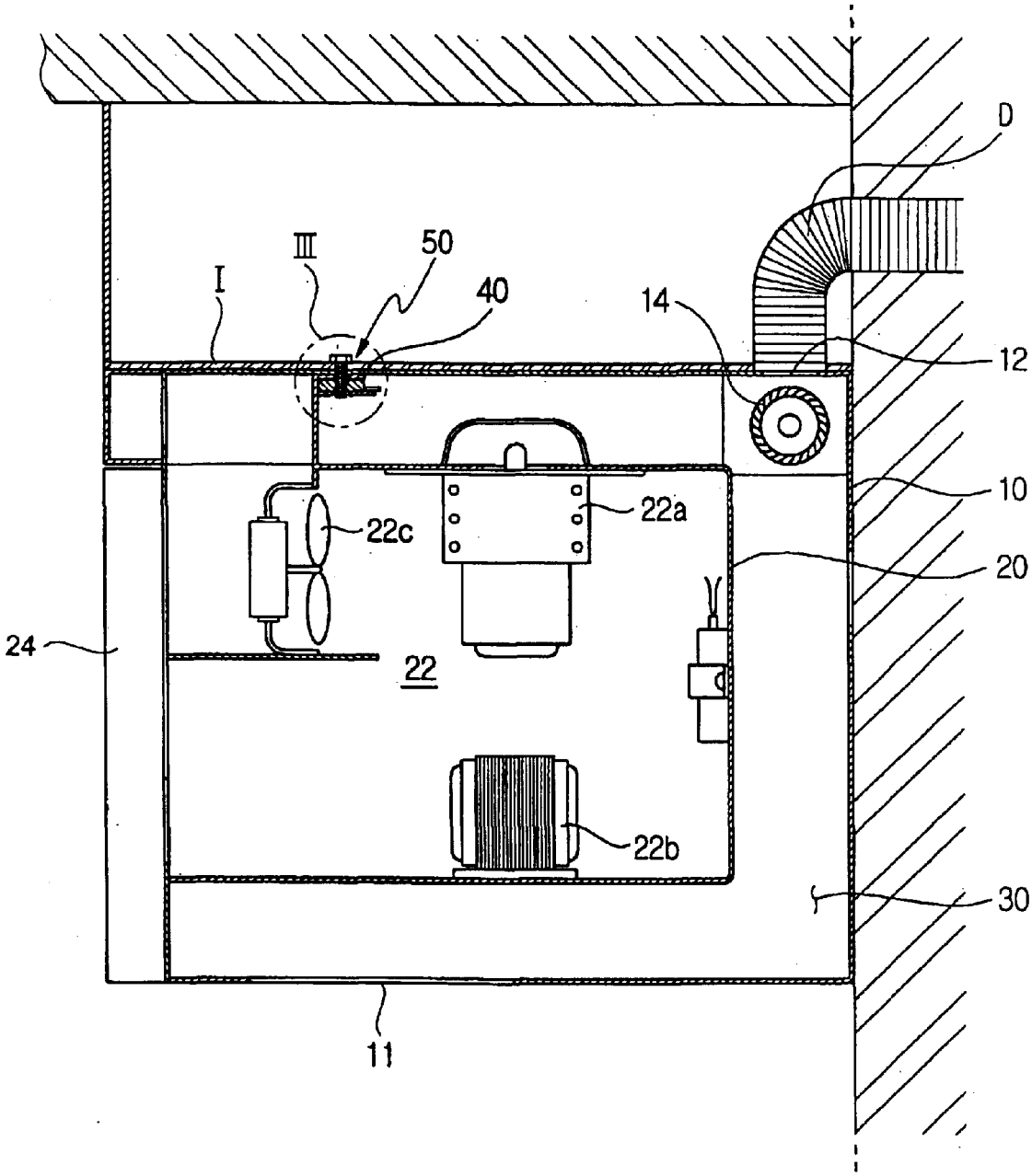
FIG. 2 is a cross-sectional view of the wall-mounted type microwave oven shown in FIG. 1, which is installed to a wall in a kitchen.

FIG. 1 is a perspective view of a wall-mounted type microwave oven according to an embodiment of the present invention, and FIG. 2 is a side cross-sectional view of the microwave oven shown in FIG. 1, which is installed to a wall in a kitchen.

As shown in FIGS. 1 and 2, the wall-mounted type microwave oven according to the embodiment of the present invention is installed to a lower surface of an installation base "I" provided at a ceiling or a kitchen cabinet, which is positioned over a gas oven range (not shown). The wall-mounted type microwave oven is located at an upper surface thereof with an outer duct D, which is connected to the wall-mounted type microwave oven through the ceiling or the kitchen cabinet, so as to guide exhaust gas and food odors generated from the gas oven range positioned therebelow, to the outside.

The wall-mounted type microwave oven includes an outer cabinet 10 defining an outer appearance of the wall-mounted type microwave oven, and an inner cabinet 20 disposed in the outer cabinet 10 with a predetermined spacing therebetween, so as to enable the predetermined spacing to serve as an inner duct 30 to guide contaminated air therethrough.

The inner cabinet 20 includes a cooking chamber 21 to cook foods therein, and an electric component compartment 22 to receive various electric components, the cooking chamber 21 and the electric component compartment 22 being isolated from each other. The cooking chamber 21 is opened and closed by a door 23 hingedly coupled to a front surface of the cooking chamber 21. The electric component compartment 22 includes at a front surface thereof a control panel 24 to control various operations of the wall-mounted type microwave oven, which is positioned adjacent to the door 23.

The electric component compartment 22 includes electric components such as a magnetron 22*a* to generate high-frequency electromagnetic waves into the cooking chamber 21, a high voltage transformer 22*b* to apply high voltage to the magnetron 22*a*, and a cooling fan 22*c* to cool the electric components received in the electric component compartment 22.

A lower panel, which defines a lower surface of the outer cabinet 10, includes at sides thereof intake ports 11, so as to introduce the contaminated air containing exhaust gas and the food odors generated from the gas oven range positioned therebelow, into the outer cabinet 10. An upper panel, which defines an upper surface of the outer cabinet 10, includes an exhaust port 12, so as to exhaust the contaminated air introduced into the outer cabinet 10, to the outside.

The inner duct 30 defined between the outer cabinet 10 and the inner cabinet 20 extends from under the inner cabinet 20 to the exhaust port 12 through a rear surface of the inner cabinet 20, so as to guide the contaminated air introduced through the intake port 11 to the exhaust port 12. The outer cabinet 10 is provided at a rear and upper portion thereof with a fan motor 13 to generate a turning force, and a pair of exhaust fans 14 joined to driving shafts of the fan motor 13 to generate a suction force.

Thus the contaminated air, generated from the gas oven range, is introduced into the outer cabinet 10 through the intake port 11 by the suction force caused by the fan motor 13 and the exhaust fans 14, and is guided to the outer duct D through the inner duct 30 and the exhaust port 12, thereby allowing the contaminated air to be exhausted to the outside.

Figure 3:
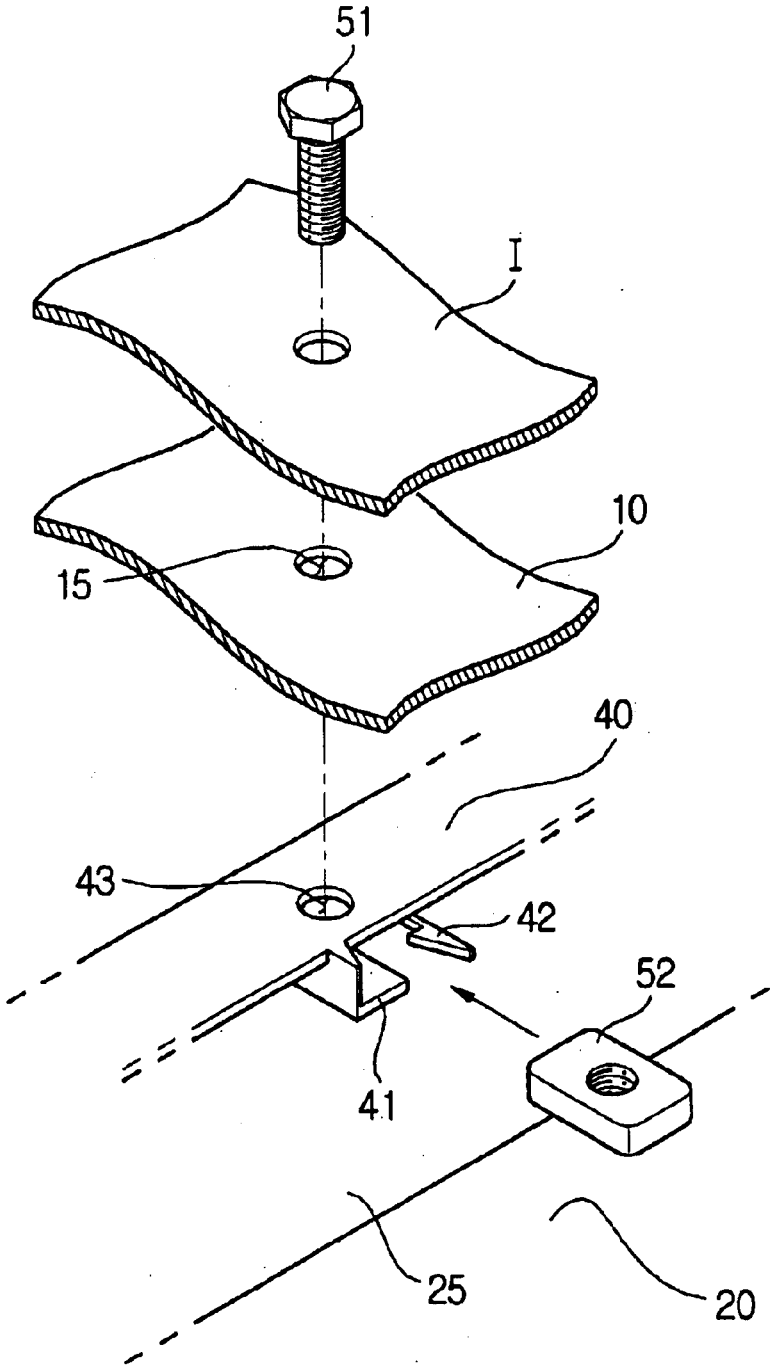
FIG. 3 is an exploded perspective view of portion III of FIG. 2.
Figure 4:
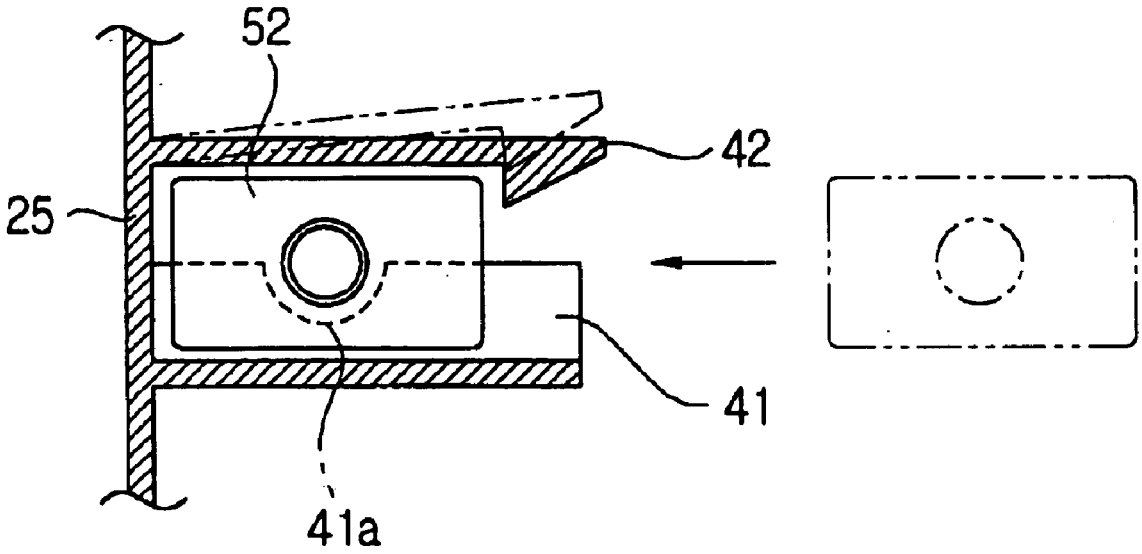
FIG. 4 is a plan cross-sectional view of a seat piece, a hook piece and a nut, according to the embodiment of the present invention.

As shown in FIG. 3, to install the wall-mounted type microwave oven to the installation base I provided at a ceiling or a cabinet, for example, in a kitchen, the inner cabinet 20 is provided at an upper surface thereof with a hanger member 40, which laterally extends parallel to the installation base I. Furthermore, the wall-mounted type microwave oven includes a fastening device 50 to secure the hanger member 40 to the installation base I.

The hanger member 40 secures the inner cabinet 20 to the installation base I together with the outer cabinet 10. The hanger member 40 extends rearwardly from an upper end of a partition plate 25, which is located at an upper portion of the electric component compartment 22 to guide air introduced into the outer cabinet 10 toward the electric component compartment 22.

The fastening device 50 comprises a bolt 51 which sequentially passes through the installation base I, the outer cabinet 10 and the hanger member 40, and a nut 52 which is disposed on a lower surface of the hanger member 40 and engages with the bolt 51 to secure the hanger member 40 and the outer cabinet 10 to the installation base I. To allow the bolt 51 to pass through the outer cabinet 10, the outer cabinet 10 is formed with a first through hole 15, and the hanger member 40 is formed with a second through hole 43.

The hanger member 40 includes a seat piece 41 extending downwardly from the hanger member to allow the nut 52 to be placed thereon, and a resilient hook piece 42 to allow the nut 52 to be precisely seated on the seat piece 41 and to prevent the nut seated on the seat piece 41 from being separated therefrom.

The seat piece 41 extends downwardly from the hanger member 40 and is laterally bent to have an "L"-shaped form, so that an end of the seat piece 41 is spaced from the resilient hook piece 42. The seat piece 41 is formed at about its midpoint with a cut portion 41*a*, so as to allow the bolt 51 to pass through the seat piece 41. The resilient hook piece 42 is positioned at an opening side of the seat piece 41 to allow the nut 52 to be stably disposed therebetween.

The nut 52 may comprise a square nut to prevent the nut 52 from rotating with respect to the seat piece 41 and the resilient hook piece 42.

Accordingly, when the nut 52, which is square, is inserted between the seat piece 41 and the resilient hook piece 42 by an external force, the resilient hook piece 42 is resiliently deformed and then restored to a normal state thereof, thereby holding the nut 52 in place. After the nut 52 is completely inserted between the seat piece 41 and the resilient hook piece 42, the nut 52 cannot be separated from the seat piece 41. In this state, the nut 52 engages with the bolt 51 passed through the installation base I, the outer cabinet 10, and the hanger member 40. Thus, the outer cabinet 10 and the inner cabinet 20 is firmly securable to the installation base I in a suspended state.

Although the hanger member 40 is integrally formed with and extends upwardly from the inner cabinet 20, the hanger member 40 may extend from various parts provided on the upper surface of the inner cabinet 20.

An operation of installing the wall-mounted type microwave oven according to the embodiment of the present invention will now be described in detail.

First, when the nut 52 is inserted between the seat piece 41 and the resilient hook piece 42 by the external force, the resilient hook piece 42 is resiliently deformed. After the nut 52 is stably seated on the seat piece 41, the resilient hook piece 42 is resiliently restored to the normal position thereof, thereby preventing the nut 52 from being separated from the seat piece 41.

Subsequently, the wall-mounted type microwave oven is positioned under the installation base I. The bolt 51 is passed through the first through holes 15 of the installation base I and the outer cabinet 10 and the second through hole 43 of the hanger member 40, and then is rotated to engage with the nut 52 disposed on the seat piece 41. Since the nut 52 is formed into a square shape to cause opposite sides thereof to be in contact with the seat piece 41 and the resilient hook piece 42, a rotation of the nut 52 is prevented. As the bolt 51 rotates, the bolt 51 is tightly fastened to the nut 52. Therefore, the inner cabinet 20 as well as the outer cabinet 10 is firmly secured to the installation base I by the hanger member 40 and the fastening device 50.

As is apparent from the above description, a wall-mounted type microwave oven having a hanger member enables an inner cabinet as well as an outer cabinet of the wall-mounted type microwave oven to be secured to an installation area in a kitchen. Therefore, since a weight of the wall-mounted type microwave oven is evenly distributed to the inner and outer cabinets, a deformation of the outer cabinet is prevented.

In addition, since the wall-mounted type microwave oven enables a nut to be held on a hanger member extending from a partition plate defining a flow path to cool an electric component compartment without additional parts, a production cost of the wall-mounted type microwave oven is reduced.

Although a preferred embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A wall-mounted type microwave oven secured to an installation base and, comprising:

an outer cabinet defining an outer appearance of the wall-mounted type microwave oven;

an inner cabinet disposed in the outer cabinet with a predetermined spacing therebetween, and including a cooking chamber to cook foods therein and an electric component compartment to receive electric components, the cooking chamber and the electric component compartment being isolated from each other;

a hanger member located between the outer cabinet and the inner cabinet, and extending rearwardly toward a back portion of the microwave oven at an upper portion of the electric component compartment to allow the inner cabinet to be secured to the installation base; and a fastening device to secure the hanger member to the installation base.

2. The wall-mounted type microwave oven as set forth in claim 1, wherein the fastening device comprises:

a nut; and a bolt passing through the installation base, the outer cabinet and the hanger member, in sequence and the nut engaging with the bolt.

3. The wall-mounted type microwave oven as set forth in claim 1, further comprising:

a partition plate, wherein the hanger member extends from the partition plate, which is attached to an upper and front portion of the inner cabinet defining the electric component compartment to define a flow path to cool the electric component compartment.

4. A wall-mounted type microwave oven secured to an installation base, and comprising:

an outer cabinet defining an outer appearance of the wall-mounted type microwave oven;

an inner cabinet disposed in the outer cabinet with a predetermined spacing therebetween, and including a cooking chamber to cook foods therein and an electric component compartment to receive electric components, the cooking chamber and the electric component compartment being isolated from each other;

a hanger member extending from the inner cabinet to allow the inner cabinet to be secured to the installation base, wherein the hanger member comprises:

a seat piece on which the nut is seated, and a resilient hook piece to allow the nut to be seated on the seat piece and to prevent the nut from separating from the seat piece; and a fastening device to secure the hanger member to the installation base, wherein the fastening device comprises a nut, and a bolt passing through the installation base, the outer cabinet and the hanger member in sequence and the nut engaging with the bolt.

5. The wall-mounted type microwave oven as set forth in claim 4, wherein the seat piece extends downwardly from a lower surface of the hanger member and is laterally bent to have an "L"-shaped section, as a bent portion, such that the nut is seatable on the bent portion, and wherein the resilient hook piece is positioned at an opening side of the seat piece to prevent the nut from separating from the seat piece.

6. The wall-mounted type microwave oven as set forth in claim 5, wherein the nut has a square shape, which is in contact with the seat piece and the resillient hook piece at sides thereof, so as to prevent the nut from rotating when the bolt engages therewith.

7. A wall-mounted type microwave oven mounted to an installation base, comprising:

an outer cabinet defining an outer appearance of the wall-mounted type microwave oven;

an inner cabinet disposed in the outer cabinet with a predetermined spacing therebetween; and a hanger unit located between the outer cabinet and the inner cabinet, and extending rearwardly toward a back portion of the microwave oven, and attaching to the inner and outer cabinets and the installation base to prevent a deformation of the outer cabinet.

8. A wall-mounted type microwave oven mounted to an installation base, comprising:

an outer cabinet defining an outer appearance of the wall-mounted type microwave oven;

an inner cabinet disposed in the outer cabinet with a predetermined spacing therebetween; and a hanger unit located between the outer cabinet and the inner cabinet, extending rearwardly toward a back portion of the microwave oven and attaching directly to the inner cabinet-and the installation base to prevent a deformation of the outer cabinet.

9. The wall-mounted type microwave oven as set forth in claim 8, wherein the hanger unit comprises:

a hanger member extending from the inner cabinet to allow the inner cabinet to be secured to the installation base; and a fastening device to secure the hanger member to the installation base.

10. The wall-mounted type microwave oven as set forth in claim 9, wherein the fastening device comprises:

a nut; and a bolt passing through the installation base, the outer cabinet and the hanger member, in sequence and the nut engaging with the bolt.

11. The wall-mounted type microwave oven as set forth in claim 9, wherein the hanger unit further comprises:

a partition plate, wherein the hanger member extends from the partition plate, which is attached to an upper and front portion of the inner cabinet.

12. The wall-mounted type microwave oven as set forth in claim 9, wherein the hanger member laterally extends parallel to the installation base.

13. The wall-mounted type microwave oven as set forth in claim 9, wherein:

the inner cabinet comprises:

an electric component compartment; and the hanger member secures the inner cabinet to the installation base together with the outer cabinet and guides air introduced into the outer cabinet toward the electric component compartment.

14. The wall-mounted type microwave oven as set forth in claim 9, wherein the hanger member is integrally formed with and extends from the inner cabinet.

15. The wall-mounted type microwave oven as set forth in claim 14, wherein the hanger member extends upwardly from an upper surface of the inner cabinet.

16. A wall-mounted type microwave oven mounted to an installation base, comprising:

an outer cabinet defining an outer appearance of the wall-mounted type microwave oven;

an inner cabinet disposed in the outer cabinet with a predetermined spacing therebetween; and a hanger unit attaching directly to the inner cabinet and the installation base to prevent a deformation of the outer cabinet, wherein the hanger unit comprises a hanger member extending from the inner cabinet to allow the inner cabinet to be secured to the installation base wherein the hanger member comprises:

a seat piece on which the nut is seated, and a hook piece to position the nut on the seat piece and to prevent the nut from separating from the seat piece, and a fastening device to secure the hanger member to the installation base, wherein the fastening device comprises a nut, and a bolt passing through the installation base, the outer cabinet and the hangar member, in sequence and the nut engaging with the bolt.

17. The wall-mounted type microwave oven as set forth in claim 16, wherein the seat piece extends from a lower surface of the hanger member to seat the nut thereon, and the hook piece is positioned adjacent to the nut when the nut is seated on the seat piece and the nut has at least one flat side communicating with the hook piece to prevent the nut from rotating when the nut is seated on the seat piece.

18. The wall-mounted type microwave oven as set forth in claim 17, wherein the nut has a non-circular shape, which is in contact with the seat piece and the hook piece at sides thereof, so as to prevent the nut from rotating when the bolt engages therewith.

19. The wall-mounted type microwave oven as set forth in claim 16, wherein the seat piece is an "L"-shaped section.

20. The wall-mounted type microwave oven as set forth in claim 16, wherein the seat piece is formed at about a midpoint thereof with a cut portion so as to allow the bolt to pass through the seat piece.

21. A wall-mounted type microwave oven mounted to an installation base, comprising:

an outer cabinet defining an outer appearance of the wall-mounted type microwave oven;

an inner cabinet disposed in the outer cabinet; and a hanger unit located between the outer cabinet and the inner cabinet, extending rearwardly toward a back portion of the microwave oven and attaching between the installation base and the inner cabinet such that a weight of the wall-mounted type microwave oven is evenly distributed to the inner and outer cabinets.

22. A wall-mounted type microwave oven mounted to an installation base, comprising:

an outer cabinet defining an outer appearance of the wall-mounted type microwave oven;

an inner cabinet disposed in the outer cabinet with a predetermined spacing therebetween;

an electric component compartment including electric components therein to supply microwaves thereby;

a partition plate disposed between the inner and outer cabinets and defining a flow path to cool the electric components in the electric component compartment;

a fastener; and a hanger member located between the outer cabinet and the inner cabinet, extending rearwardly toward a back portion of the microwave oven from and fastened to the partition plate by the fastener and attached to the installation base.

* * * * *